US006321420B1

(12) United States Patent
Spancer

(10) Patent No.: US 6,321,420 B1
(45) Date of Patent: Nov. 27, 2001

(54) TOBACCO BUCKLE PIPE

(76) Inventor: Stanley Spancer, 4501 Cedros Ave. #340, Sherman Oaks, CA (US) 91403

( * ) Notice: Subject to any disclaimer, the term of this patent is extended or adjusted under 35 U.S.C. 154(b) by 0 days.

(21) Appl. No.: 09/523,971

(22) Filed: Mar. 13, 2000

Related U.S. Application Data

(60) Provisional application No. 60/149,164, filed on Aug. 16, 1999.

(51) Int. Cl.[7] ..... A44B 11/24

(52) U.S. Cl. ..... 24/188; 24/187; 24/181; 24/163 K

(58) Field of Search ..... 24/188, 187, 186, 24/181, 163 K; 224/163

(56) References Cited

U.S. PATENT DOCUMENTS 3,252,194 * 5/1966 Albiniano ..... 24/188
4,521,939 * 6/1985 Chabot et al. ..... 24/188
4,562,620 * 1/1986 Oliver, Jr. ..... 24/163 K
5,609,281 * 3/1997 West ..... 224/163

* cited by examiner

*Primary Examiner*—Victor N. Sakran
(74) *Attorney, Agent, or Firm*—Roger A. Marrs

(57) ABSTRACT

A tobacco belt buckle pipe serves as a closure for the opposite ends of a belt and also serves as a smoking pipe. The buckle pipe includes a geometrically shaped tubing which includes an endless internal passageway having an opening defined as a receptacle for insertably receiving a quantity of tobacco and further having a slit opening in the tubing for holding the tobacco. A rotatable closure device is provided around the tubing having an opening having a first position remote from the receptacle so as to close the receptacle and a second or operative position in registry with the receptacle during a smoking procedure. A pipe stem is secured to a rotatable bearing or coupling.

7 Claims, 2 Drawing Sheets

FIG. 3
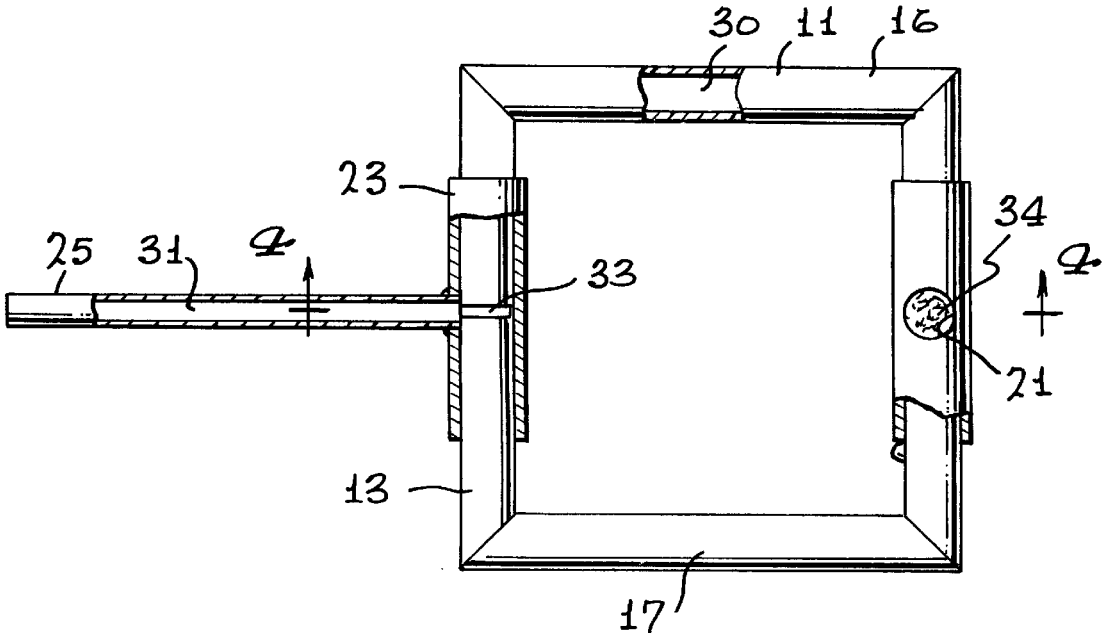
FIG. 5
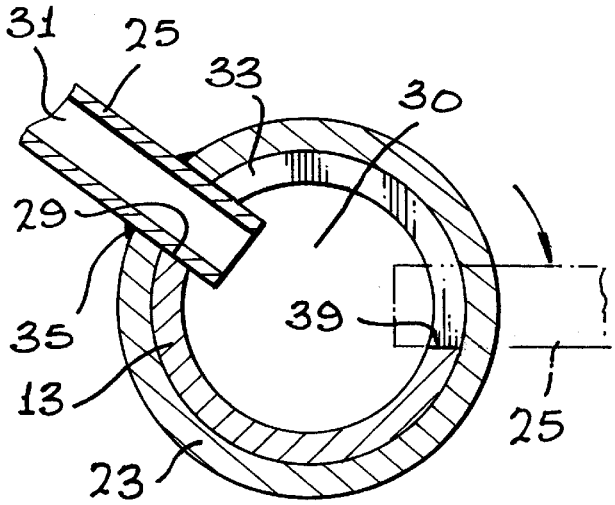
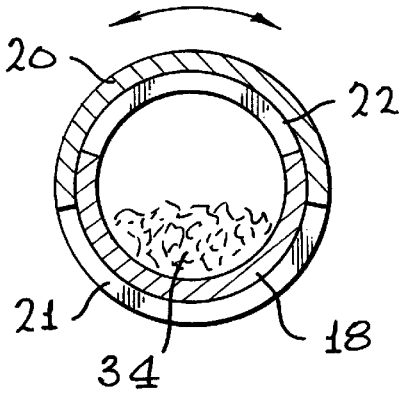
FIG. 6

TOBACCO BUCKLE PIPE

Priority claimed on Ser. No. 60/149,164 filed Aug. 16, 1999.

BACKGROUND OF THE INVENTION

1. Field of the Invention

The present invention relates to the field of smoking apparatus, and more particularly to a novel belt buckle constructed in such a fashion as to have dual purposes serving as a belt buckle or closure as well as serving as a tobacco pipe.

2. Brief Description of the Prior Art

In the past, it has been the conventional practice to provide a pipe for smoking tobacco which includes a bowl having an elongated stem with an internal passageway communicating with the interior of the bowl. In general, a quantity of tobacco is placed inside the interior of the bowl and is ignited by a match or the like while the user is drawing air into the bowl, around the tobacco and through the stem passageway. In other instances, conventional pipes might have taken the form of decorative items wherein the bowl was carved or formed to represent various graphic renderings so as to disguise the item as a pipe. In other instances, prior pipes have included means for filtering the smoke of the pipe through water or other filtration systems prior to inhalation by the user.

Difficulties and problems have been encountered with each of the respective prior devices which stem largely from the fact that the pipes were used for solely smoking purposes and did not have any other function or utility. Furthermore, no apparent effort has been made to disguise or to configure a pipe into a decorative or utilitarian device which is totally non-associated with the smoking procedure.

Therefore, a long-standing need has existed to provide a pipe in a suitable form which is not only decorative but incorporates a totally different function as in the function associated with a smoking procedure. Such a device should be able to hold a quantity of tobacco and provide sufficient draft for ignition and maintain burning of the tobacco while the device is being smoked. The device should be unrecognizable as a pipe from a visual and functional standpoint.

SUMMARY OF THE INVENTION

Accordingly, the above problems and difficulties are avoided by the present invention which provides a novel tobacco belt pipe which in one functional application serves as a closure for the opposite ends of a belt and in another functional application serves as a smoking pipe. The belt pipe of the present invention includes a rectangular or other geometrically shaped tubing which includes an endless passageway having an opening defined as a receptacle for insertably receiving a quantity of tobacco and further having a plurality of apertures arranged around the tubing wherein the plurality of apertures are in a remote and spaced-apart relationship with respect to the receptacle for holding the tobacco. Closure means are provided around the tubing so as to be rotatable thereon and which further include an opening having a position remote from the receptacle so as to close the receptacle and a second or operative position where the opening is in registry with the receptacle during a smoking procedure. Means are provided for orienting the closure means whereby the means will only rotate and will not slide along the length of the tubing on which it is mounted. A pipe stem is secured to a rotatable bearing which is carried in rotatable relationship on the tubing remote from the closure device. The passageway in the pipe stem is open-ended, having one end in communication with the slit provided in the tubular member. Therefore, as the pipe stem is rotated about its mounting on the tubular member, the passageway in the pipe stem will always be in registry with the slit and the passageway.

A further object of the present invention provides a novel belt buckle having means for accepting a quantity of tobacco which may be readily smoked through a pipe stem and which further includes passageways through the pipe stem, the buckle frame and further includes a closure for the receptacle.

Yet another object resides in providing a belt buckle which may be readily assembled and disassembled from an end of a belt and which may be used as a smoking pipe when disassembled from the belt and that may be used as a closing buckle for the opposite end of the belt when it's in its non-operating smoking condition.

Therefore, the belt buckle pipe of the present invention serves not only as a belt buckle but also serves as a smoking pipe. Both uses are distinct from one another in that visually one use of the device is not discernible from the other use of the device.

Therefore, it is among the primary objects of the present invention to provide a novel buckle pipe which serves the dual purpose as a belt buckle and a smoking pipe.

Another object of the present invention is to provide a novel belt buckle pipe which includes a tubular frame having a linear segment with a quill for receiving and packing a quantity of tobacco while including a closure element with an opening suitably registerable with the receptacle and which further includes a pipe stem serving both as a pipe mouthpiece as well as a tang for a belt buckle.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 3 is a top plan view, partly in section, of the buckle pipe;

FIG. 5 is a greatly enlarged transverse sectional view of the pipe stem coupling with the frame of the buckle in accordance with arrows 4—4 in FIG. 4; and FIG. 6 is a cross sectional view showing the fire-bed in a closed position.

DESCRIPTION OF THE PREFERRED EMBODIMENT

Figure 1:
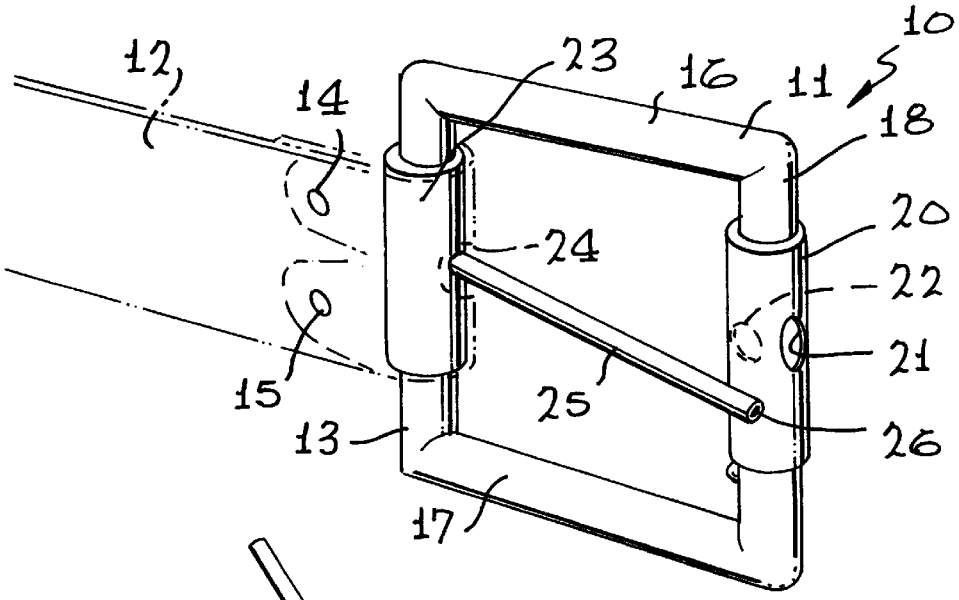
FIG. 1 is a front perspective view showing the novel tobacco belt pipe incorporating the present invention.

Referring to FIG. 1, the novel belt buckle pipe invention incorporating the present concept is indicated in the general direction of arrow 10 which includes a buckle frame 11 that is detachably carried on the end of a belt 12 such as by wrapping the terminating end of the belt around a linear section 13 of the frame and snapping the end together by means of snap fasteners 14 and 15 respectively. It is to be noted that the frame 11 includes side frame sections 16 and 17 as well as an end frame section 18. The frame sections 13, 16, 17 and 18 form a triangle in plan view and include an interior continuous passageway interconnecting all of the sections together. On frame section 18, there is provided a closure element 20 which is rotatably mounted on the section 18 and the element includes an opening 21 which may be put into registry with an opening 22 in the frame section 18. When the element 20 is rotated to one position, the hole or opening 22 is closed while rotating the element in the opposite direction places the hole 21 in registry with the hole 22. When in registry, the combined or registered openings define a bowl into which tobacco may be placed preparatory for the smoking procedure.

Additionally, a rotating stem element 23 is provided which rotates on the section 13 and around which the terminating end of belt 12 is trained. The belt includes an aperture 24 through which a pipe stem or tang 25 projects. When the device is used as a buckle, the tang 25 may be inserted through openings in the end of belt 12 opposite from its end carrying the buckle. When used during a smoking procedure, the stem 25, which includes an open-ended passageway 26, is employed for drawing smoke of air therethrough from the passageway within the frame 11. Therefore, it can be seen that the passageway 26 in the stem 25 is in communication with the fire bowl defined by registry of the openings 21 and 22 respectively via the continuous passageway in the frame 11.

Figure 2:
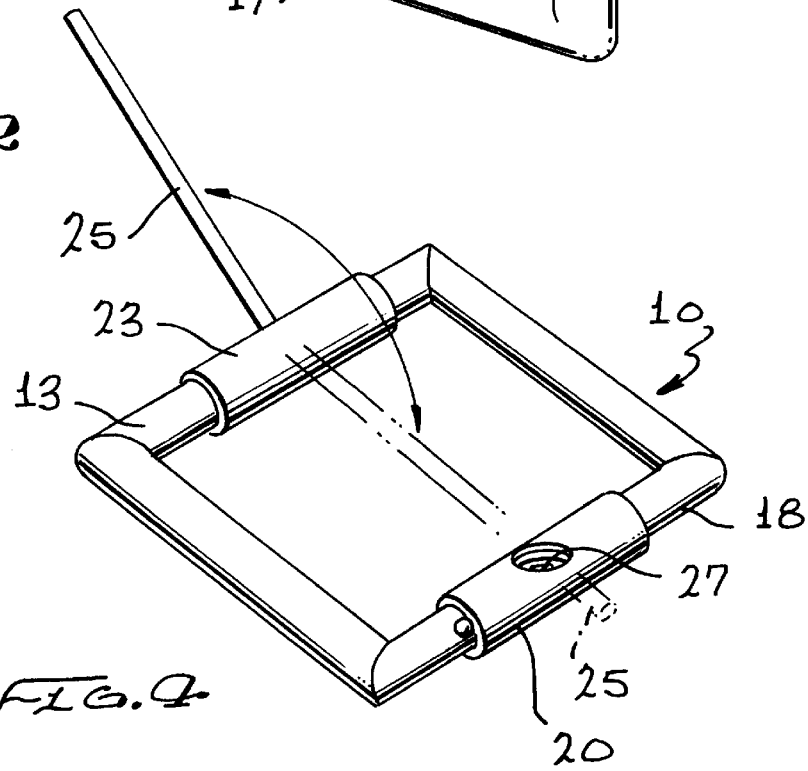
FIG. 2 is a perspective view of the buckle pipe as shown in FIG. 1 disconnected or disassembled from the belt preparatory for a smoking procedure.

Referring now in detail to FIG. 2, the device 10 is illustrated with the closure element 20 rotated on section 18 to register openings 21 and 22 so as to create a fire bowl into which tobacco 27 may be placed. Also, it can be seen that the element 23 carrying the pipe stem or tang 25 is rotatably mounted on the opposite section of the frame identified by numeral 13.

Referring to FIG. 3, it can be seen that numeral 30 identifies the continuous passage defined by the frame 11 and that the continuous passage is unrestricted so as to communicate flow of smoke or the like from the registered holes 21 and 22 defining the fire bowl with the passageway 31 formed in the stem or tang 25. Also, it can be seen that the frame section 13 not only rotatably supports the element 23 but includes a plurality of openings such as opening 33 so that fluid communication between passageway 31 and passageway 30 is provided. Therefore, no matter where the element 23 is rotated on section 13, communication is established between the stem passageway 31 and the openings 33.

Figure 4:
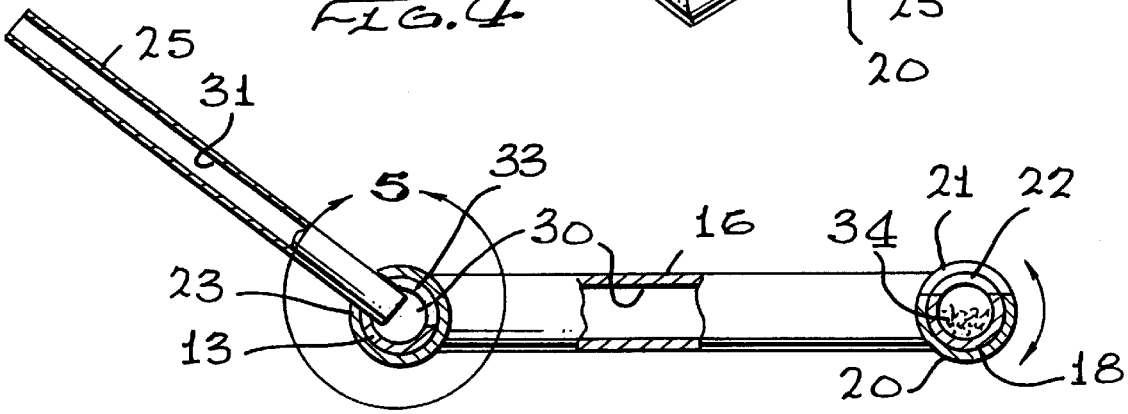
FIG. 4 is a sectional view of the buckle pipe shown in FIG. 3 as taken in the direction of arrows 4—4 thereof.

Referring now in detail to FIGS. 4 and 5, it can be seen that the stem 25 is rotatable on the section 13 of the frame 11 and that the element 20 is rotatable on the frame section 18. In FIG. 4, the openings 20 and 21 are in registry so as to define a bowl portion for receiving tobacco such as illustrated by numeral 34.

FIG. 4 also illustrates the plurality of openings 33 provided in section 13 of the frame 11 and that, as previously described, passageway 31 is in communication through the plurality of holes with passageway 30 in the frame 11.

Referring now in detail to FIG. 5, an enlarged view is illustrated showing the relationship between passageway 31 and the slit or opening 33. Usually, the opening 33 will be in communication with the passageway 31 in the stem 25 during a smoking procedure. The ends of the slit indicated by numerals 29 and 39 serve as stops for limiting rotation of the element 23.

Therefore, it can be seen that in the assembly shown in FIG. 1, the device 10 forms a buckle with the tang 25 serving as a closure element to be inserted through openings in the opposite end of the belt 12 from the end carrying the buckle frame 11. The element 20 becomes a simple anti-friction device over which the length of the belt may be trained so as not to bind or catch with the element 18 of the frame. Likewise, the tang (pipe stem 25) rotates on element 23 on the frame section 13. The end of tang 25 is attached to the element 23 by means of a fillet such as indicated by numeral 35 in FIG. 5. In FIG. 6, the openings 21 and 22 are not normally indexed or in registry.

Referring now to FIGS. 3 and 4, it can be seen that when the element 23 is rotated on frame section 13, the device may be used as a smoking pipe. In this assembly, element 20 is rotated so that the openings 21 and 22 are in alignment and are in registry with one another so that a quantity of tobacco 34 can be inserted through the registered openings to form a firebed. Likewise, the element 23 is rotated to the position whereby the pipe stem 25 outwardly projects from the frame section 13. Passageway 31 is now in communication with the passageway 30 by means of the opening or slit 33 in the frame section 13. A person may now place the free end of the stem 25 into his mouth and may draw through the passageways in order to maintain the tobacco lit.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A belt buckle pipe comprising:

a tubular frame having a continuous passageway;

a first opening in said frame;

a cylindrical element rotatably mounted on said frame and having an opening selectively registerable with said first opening to define a firebed receptacle;

a cylindrical piece rotatably carried on said frame in spaced-apart relationship with respect to said cylindrical element;

a semicircular slit provided in said frame beneath said cylindrical piece; and an elongated open-ended stem secured to said cylindrical piece and having an open end in communication with said passageway via said slit.

2. The invention defined in claim 1 wherein:

said cylindrical element adapted to slide laterally on said frame; and first stop means fixed on said frame for limiting extent of slidable movement on said frame.

3. The invention defined in claim 2 including:

second stop means carried on said frame engageable with said stem to limit rotatable movement of said cylindrical piece.

4. The invention defined in claim 3 wherein:

said first stop means is a raised nub secured to said frame engageable with said cylindrical element to restrict movement thereof when said opening and said receptacle are in alignment.

5. The invention as defined in claim 4 wherein:

said second stop means includes said slit having opposite terminating ends with said stem adapted to travel in said slit between said opposite terminating ends.

6. The invention as defined in claim 5 wherein:

said frame includes four sections arranged in square geometric configuration;

said cylindrical piece rotatably carried on a selected one of said sections and said cylindrical piece slidably carried on another section; and said selected section and said other section are in parallel spaced-apart relationship.

7. The invention as defined in claim 6 wherein:

said cylinder piece is adapted to detachably receive an end of a belt.

* * * * *